United States Patent [19]

Vassilatos

[11] 4,425,293

[45] Jan. 10, 1984

[54] PREPARATION OF AMORPHOUS ULTRA-HIGH-SPEED-SPUN POLYETHYLENE TEREPHTHALATE YARN FOR TEXTURING

[75] Inventor: George Vassilatos, Wilmington, Del.

[73] Assignee: E. I. Du Pont de Nemours and Company, Wilmington, Del.

[21] Appl. No.: 359,517

[22] Filed: Mar. 18, 1982

[51] Int. Cl.[3] ..... D01D 5/12

[52] U.S. Cl. ..... 264/176 F; 57/288; 264/178 F; 264/237

[58] Field of Search ..... 264/176 F, 178 F, 237; 57/288

[56] References Cited

U.S. PATENT DOCUMENTS

| | | | |
|---|---|---|---|
| 2,604,667 | 7/1952 | Hebeler | 264/210.8 |
| 3,002,804 | 10/1961 | Kilian | 264/181 |
| 3,549,597 | 12/1970 | Kitson et al. | 528/295 |
| 3,771,307 | 11/1973 | Petrille | 57/157 |
| 3,772,872 | 11/1973 | Piazza et al. | 57/140 R |
| 3,946,094 | 3/1976 | Kanetsuna et al. | 264/28 |
| 4,134,882 | 1/1979 | Frankfort et al. | 528/309 |

FOREIGN PATENT DOCUMENTS

| | | | |
|---|---|---|---|
| 51-75112 | 6/1976 | Japan | 264/178 F |
| 809273 | 2/1959 | United Kingdom . | |

OTHER PUBLICATIONS

Journal of Applied Polymer Science, vol. 22, pp. 2229–2243 (1978).

*Primary Examiner*—Jay H. Woo

[57] ABSTRACT

Spinning of polyethylene terephthalate yarn at speeds in excess of 5000 meters per minute and rapid quenching produces highly oriented, amorphous yarn that gives enhanced bulk on texturing.

4 Claims, 2 Drawing Figures

PREPARATION OF AMORPHOUS ULTRA-HIGH-SPEED-SPUN POLYETHYLENE TEREPHTHALATE YARN FOR TEXTURING

BACKGROUND OF THE INVENTION

U.S. Pat. No. 3,771,307 discloses the production of a polyester feed yarn for false twist texturing. The feed yarn is spun at speeds typically below 4000 meters per minute (m./min.) and is air quenched. For reasons of economy it is desirable to spin at higher speeds. The spinning of polyethylene terephthalate yarn at ultra-high speeds is shown in U.S. Pat. No. 4,134,882. The air-quenched yarn resulting from this process is highly oriented and highly crystalline. A less crystalline feed yarn would be more suited for texturing.

The production at ultra high speed of an amorphous, highly oriented, polyethylene terephthalate feed yarn for false-twist texturing is a desirable objective.

SUMMARY OF THE INVENTION

The present invention provides an oriented amorphous polyethylene terephthalate feed yarn for false-twist texturing by spinning polyethylene terephthalate at a speed of at least 5,000 m./min. and quenching in a liquid bath to provide filaments having a boil off shrinkage (BOS) of at least 45% and no detectable crystallinity as measured by customary X-ray diffraction procedures. Also included in this invention is a false-twist texturing process that provides enhanced bulk by virtue of using the resulting yarn of such process.

DETAILED DESCRIPTION

Figure 1:
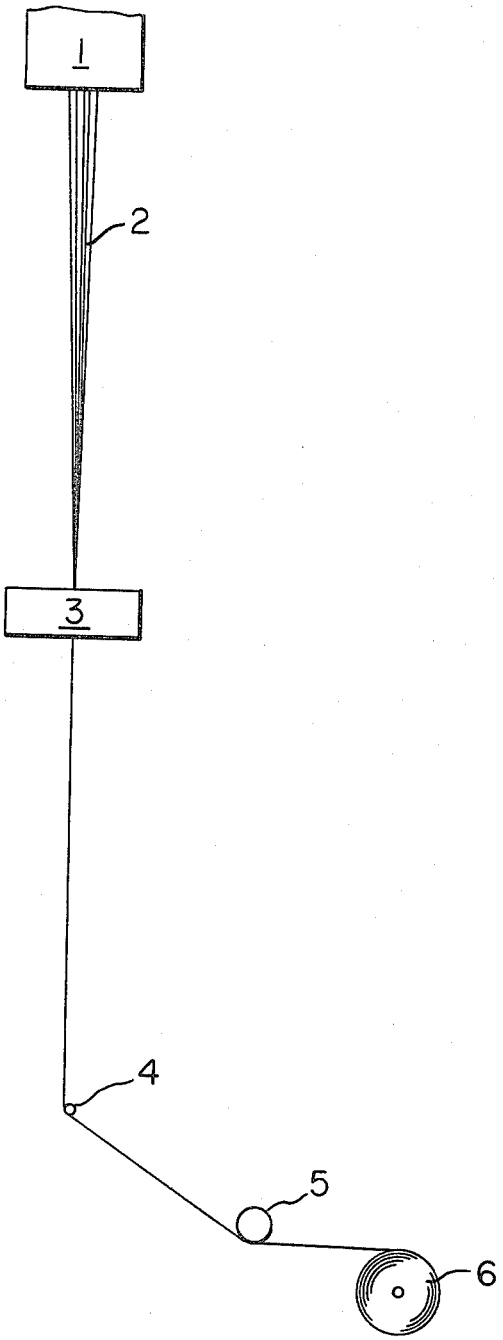
FIG. 1 is a schematic representation of an apparatus on which the feed yarn of the invention may be prepared.

Preparation of the feed yarn of the invention will be readily understood by reference to FIG. 1. Polyethylene terephthalate is melted and extruded in a conventional manner from spinneret 1 to form a plurality of filaments 2. The molten polymer is cooled by exposure to air in the space between spinneret 1 and the surface of liquid in quench bath 3. Quench bath 3 is located at a distance from the spinneret such that the filaments are still amorphous. The filaments enter bath 3 in which rapid cooling arrests crystallization. The quenched filaments are converged into a yarn which travels around withdrawal roll 4 and guide 5 to windup package 6.

The key elements in the process of preparing the feed yarn are the spinning speed and the location of the liquid quench bath. The spinning speed which is measured at yarn withdrawal roll 4 exceeds 5000 m./min. From the standpoint of increased productivity it should preferably be greater than 5500 m./min. At these spinning speeds there is a tendency for the yarns to be highly crystalline. The quench process of the invention is responsible for maintaining the amorphous nature of the yarn.

As is shown in Heuval et al., J. Applied Poly Sci. Volume 22, 2229–2243 (1978), the crystallinity of as-spun polyethylene terephthalate yarn increases dramatically with increased speed at levels above about 4000 m./min. If in the process of spinning the yarn at speeds greater than 4000 m./min., it is quenched too far downstream, the yarn becomes crystalline. Once the yarn becomes crystalline, quenching will not render it amorphous. On the other hand, quenching too soon in such a process will result in yarn breaks and yarn of inferior quality characterized by coalesced filaments, broken filaments, etc. Applicant has found that the point of crystallization can be determined and if the yarn is quenched in a liquid quench bath at about this point, one obtains highly oriented and yet amorphous filaments. The location of the liquids quench bath to achieve this result is most easily determined on a trial and error basis. For example, at a spinning temperature of 310° C. and a spinning speed of 6200 ypm (5669 m./min.) for a 75 den./17 fil. yarn, placement of the quench bath at 38 inches (96.5 cm.) from the spinneret leads to an amorphous yarn with 67% BOS and a density of 1.357 gm./ml. The X-ray diffraction pattern of the yarn is characterized by a diffuse halo, which indicates the absence of crystallinity. Placement of the quench bath at 42 inches (107 cm.) from the spinneret leads to a crystalline yarn with a BOS of 15% and density of 1.385 gm./ml. An X-ray diffraction test reveals a distinct pattern indicating crystallinity. The amorphous material is a more texturable product.

A liquid quench bath is selected to achieve rapid quenching. Room temperature water has been found to be quite suitable for this purpose. It is important that the crystallization process be arrested within a short period of time. Air quenching is inadequate.

The exact distance from the spinneret where the yarn crystallizes is a function of several variables such as spinning speed and filament size, but is easily located by a simple measurement of boil-off shrinkage of the yarn being spun. Table A records the results of BOS measurements on a 17 filament, 4.4 denier per filament (dpf) yarn spun at 310° C. using a spinning speed of 6500 ypm (5944 mpm) with the quench bath located at various distances from the spinneret. The big change is BOS values between distances of 30 and 32 inches indicates that the onset of crystallization occurs when the filament is about 31 inches from the spinneret. To obtain amorphous yarn at this spinning speed, the quench bath should be located no further than about 31 inches (78.7 cm.) from the spinneret.

TABLE A

Effect of Water Quench Location on % BOS at Constant Speed and Filament Size

| Water Quench Distance from Spinneret Inches (cm) | % BOS |
|---|---|
| 28 (71) | 58.8 |
| 30 (76) | 56.3 |
| 32 (81) | 10.4 |
| 36 (91.4) | 10.8 |
| 40 (101.6) | 12.5 |
| 42 (106.7) | 11.1 |
| 59 (150) | 10.5 |

As a further indication of the ease of establishing the distance from the spinneret at which crystallization begins, consider the data in Table B where BOS values are recorded for yarn spun at 310° C. at various speeds with the quench bath at room temperature in a fixed location at 34 in. (86.4 cm.) from the spinneret. Constant polymer throughput is maintained so that dpf decreases as spinning speed increases. The large change in BOS between spinning speeds of 6400 and 6600 ypm indicates that under these conditions the onset of crystallization occurs at a spinning speed of about 6500 ypm (5944 mpm). With higher spin temperatures, the quench bath may be located further from the spinneret.

TABLE B

Effect of Spinning Speed on % BOS at Constant Quench Bath Distance

| ypm | (mpm) | dpf | % BOS |
|---|---|---|---|
| 5,500 | (5029) | 5.2 | 68.5 |
| 6,000 | (5486) | 4.8 | 65.5 |
| 6,400 | (5852) | 4.5 | 60.5 |
| 6,600 | (6035) | 4.3 | 11.7 |
| 6,800 | (6218) | 4.2 | 9.7 |
| 7,000 | (6401) | 4.10 | 9.2 |

Using data of the sort recorded in Tables A and B, the location of the point of crystallization in terms of distance from the spinneret has been determined for various spinning speeds ranging from 5500 ypm (5029 mpm) to 7000 ypm (6401 mpm) and recorded in Table C. Amorphous yarns may be obtained by locating the quench bath closer to the spinneret than the indicated point of crystallization.

TABLE C

Location of Point of Crystallization as Determined by % BOS of Produced Yarn

| Spinning Speed | | | Distance from Spinneret where Crystallization Occurs | |
|---|---|---|---|---|
| ypm | (mpm) | dpf | Inches | (cm) |
| 5,500 | (5029) | 5.2 | 59 | (150) |
| 6,000 | (5486) | 4.4 | 42 | (107) |
| 6,200 | (5669) | 4.4 | 42 | (107) |
| 6,500 | (5944) | 4.4 | 38 | (96.5) |
| 7,000 | (6401) | 4.1 | 33 | (83.8) |

The texturing of the polyester yarn can be described by reference to FIG. 2. In the figure, polyester yarn 10 is fed continuously from package 20 by feed rolls 30 and 31 and passes through texturing heater 40 and false-twisting device 50. The yarn is pulled away by pull rolls 60 and 61 and then passes over secondary heater 55 to forwarding rolls 70 and 71 which operate at a slower speed than rolls 60 and 61 thereby allowing the yarn to relax somewhat to stabilize the textured yarn and reduce its twist liveliness. Finally, the textured yarn is wound on package 75. The false twisting device 50 rotates at high speed to insert twist between itself and the rolls 30 and 31. This twisted yarn passes through heater 40. The heater softens the polyester yarn and causes crystallization. Upon cooling, the twisted configuration is locked in by the crystallized molecular arrangement. The yarn is untwisted as it exits from the twisting device to go to pull rolls 60, 61 which may be driven at a higher peripheral speed than feed rolls 30, 31 to provide a draw ratio between 1.01X and 1.2. This process can be carried out on commercially available false-twist texturing machines.

Measurements

Relative Viscosity (RV), Tensile Properties, and Boil-Off Shrinkage (BOS) are measured by the techniques described in U.S. Pat. No. 3,772,872. The presence of crystallinity is determined by X-ray diffraction procedures well-known in the art and discussed, for example, in the book *X-Ray Diffraction Methods in Polymer Science,* by L. E. Alexander, published by John Wiley and Sons, New York, N.Y. (1969).

Crimp contraction after wet heat (% CCA) of textured yarns is a measure of their crimp characteristics and is determined in the following manner: A loop skein having a denier of 5000 is prepared by winding a textured yarn on a denier reel. The number of turns required on the reel is equal to 2500 divided by the denier of the yarn. A 25 gram weight is suspended from the looped skein, giving a load of 5.0 mg./denier, and the weighted skein is immersed for 15 minutes in a water bath held at a temperature of about 97° C. After heating, the sample is removed from the bath and allowed to cool and dry. While still under the 5.0 mg./denier load, the length of the skein, $C_a$, is measured. The lighter weight is then replaced by a 500-gram weight and the length of the skein, $L_a$, is measured again. Crimp contraction is then expressed as a percentage which is calculated from the formula: $\% \text{ CCA} = (L_a - C_a)/L_a \times 100$. Higher values of % CCA indicate a better and more permanent crimp in the sample tested.

EXAMPLE I

Preparation of Texturing Feed Yarns

Using an apparatus arrangement of the type shown schematically in FIG. 1, polyethylene terephthalate having a relative viscosity of 21.4 is melt spun using a spinning temperature of 310° C. and a 17-hole spinneret in which the extrusion orifices have a diameter of 10 mils (0.25 mm.) and a length/diameter ratio of 4. Polymer throughput is 2.9 grams per minute per hole. The extruded filaments pass downwardly through a cross-flow cooling chimney for a distance of 21 inches. The cooling medium is room temperature air with a flow velocity in the chimney of about 0.33 fps (10 cms. per second).

The filaments then enter and traverse a water quench bath, the surface of which is located at a distance of 28 inches (71 cms.) from the spinneret. The depth of water traversed by the filaments is 2.25 inches (5.6 cms.). Excessively deep baths should be avoided as they tend to promote filament breakage at the high spinning speeds.

The quenched yarn is passed over a finish roll where a lubricating finish is applied, and then around withdrawal rolls operating at a speed of 6500 ypm (5944 mpm) and is finally packaged on a surface-driven bobbin windup. The yarn code is IA.

A comparison yarn IB is prepared in essentially the same manner with the exception that no water quench bath is used.

The properties of the yarns produced above are summarized in the following Table D.

TABLE D

SPUN YARN PROPERTIES

| Property | Water Quenched Yarn IA | Comparison Yarn IB |
|---|---|---|
| Yarn Denier | 77 | 77 |
| Tenacity, gpd | 3.3 | 3.8 |
| Break Elongation, % | 27 | 40.7 |
| Initial Modulus, gpd | 83 | 82.6 |
| Boil-Off Shrinkage, % | 59 | 3.6 |
| X-ray Crystallinity | Amorphous | Crystalline |

EXAMPLE II

Figure 2:
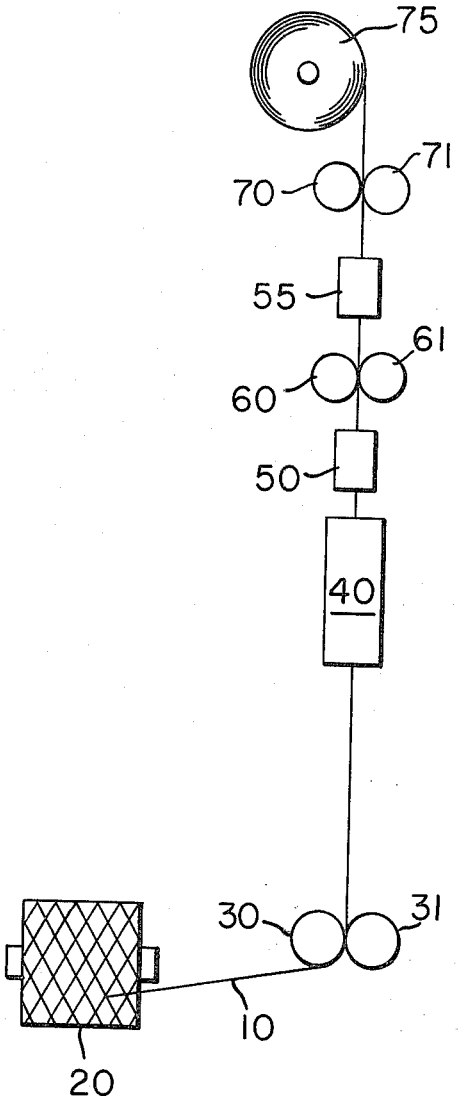
FIG. 2 is a schematic representation of a false-twisting process and suitable equipment.

Samples of water-quenched yarn IA and air-quenched yarn IB from Example I are false-twist textured as in FIG. 2 using an ARCT-480 texturing machine. The temperature of the top and bottom heaters are 200° C. and 220° C., respectively, and the texturing speed is 179 ypm (163.7 mpm) with a spindle speed sufficient to give 66.6 turns per inch (26.2 turns/cm). Overfeed to the windup is 11.3%. The texturing draw ratio used for each sample and the pre- and post-spindle tensions are shown in Table E.

The properties of the textured yarns are recorded in Table F. The significantly larger values of crimp contraction after boil-off (% CCA) for the yarns IA of the invention, vs. the control yarns IB, provide a clear indication of the improved texturing performance provided by the invention.

TABLE E

| Sample | Texturing Conditions | | | | | |
|---|---|---|---|---|---|---|
| | Water Quenched Yarn IA | | | Air Quenched Yarn IB | | |
| Code | 1 | 2 | 3 | 4 | 5 | 6 |
| Texturing draw ratio | 1.028 | 1.054 | 1.08 | 1.025 | 1.054 | 1.08 |
| Prespindle tension, gpd. | 18 ± 0.5 | 24 ± 3 | 30 ± 4 | — | 25 ± 1 | 28 ± 0.5 |
| Post-spindle tension, gpd | 40 ± 3 | 48 ± 3 | 65 ± 5 | — | 62 ± 2 | 63 ± 1 |

TABLE F

| | Set Textured Yarn Properties | | | | | |
|---|---|---|---|---|---|---|
| | Water Quenched Yarn IA | | | Air Quenched Yarn IB | | |
| Sample Code | 1 | 2 | 3 | 4 | 5 | 6 |
| Yarn denier | 161.4 | 158.5 | 151.2 | 157.6 | 149.5 | 146.8 |
| Tenacity, gpd. | 3.5 | 3.5 | 3.5 | 2.8 | 3.2 | 2.9 |
| Break elongation, % | 20.4 | 18.0 | 15.8 | 25.2 | 23.2 | 18.1 |
| Modulus, gpd. | 34.4 | 38.2 | 50 | 39.1 | 61.4 | 52.2 |
| CCA, % | 10.9 | 10.9 | 9.9 | 7.6 | 8.8 | 7.9 |

EXAMPLE III

In this example, a polyester texturing feed yarn is prepared by the general procedure described in Example I with the exception that the water quench bath is replaced by a finish roll placed at the critical quenching location.

Polyethylene terephthalate having a relative viscosity of 22.4 is melt spun using a spinning temperature of 310° C. and a 17 hole spinneret in which the extrusion orifices have a diameter of 10 mils. (0.25 mm.) and a length/diameter ratio of 4. The extruded filaments pass downwardly through a cross-flow cooling chimney as in Example I and then contact the surface of a finish roll located at a distance of 28 inches from the face of the spinneret. The finish roll is bathed in a spinning finish solution consisting primarily of water containing minor amounts of lubricating agents. The finish roll has a diameter of 4 inches (10.2 cm.) and rotates at a speed of 45 rpm. The yarn contacts the roll over a distance of $\frac{3}{8}$ inch (0.95 cm.). The quenched yarn is next passed around withdrawal rolls operating at a speed of 6500 ypm (5944 mpm) and is then packaged on a surface driven bobbin windup (yarn code 3A). The crystallinity of the yarn in evaluated by measuring the percent boil-off shrinkage.

A comparison yarn (code 3B) is prepared in the same manner with the exception that the yarn does not contact the finish roll. The boil-off shrinkage of the comparison yarn is also measured. The results are recorded in Table G.

TABLE G

| Yarn Code | Spinning Speed In ypm (mpm) | dpf | Distance of Finish Roll From Spinneret In Inches (cm.) | % BOS |
|---|---|---|---|---|
| 3A | 6500 (5944) | 4.4 | 28 (71) | 45 |
| 3B | 6500 (5944) | 4.4 | No finish roll | 3.7 |

I claim:

1. A process for preparing an oriented amorphous polyethylene terephthalate feed yarn for false-twist texturing comprising spinning polyethylene terephthalate at a windup speed of at least 5,000 m./min. and quenching in a room temperature water bath located at a distance from the spinneret such that the quenched filaments have an as-spun boil-off shrinkage of at least 45% and no detectable crystallinity as measured by X-ray diffraction.

2. A process according to claim 1 wherein the spun polyethylene terephthalate filaments are quenched in a water bath.

3. A process according to claim 1 wherein the polyethylene terephthalate is spun at a windup speed of at least 5,500 m./min.

4. In a texturing process for producing textured yarns from feed yarn composed of polyethylene terephthalate yarns, wherein the feed yarn passes continuously to a false-twisting device and a heater is used for setting twist backed up in the yarn by the false-twisting device; the improvement comprising providing higher bulk textured yarn by texturing at 1.01 to 1.2× draw ratio a highly oriented, amorphous feed yarn produced by spinning polyethylene terephthalate at a windup speed of at least 5,000 m./min. and quenching in a room temperature water bath located at a distance from the spinneret such that the quenched filaments have an as-spun boil-off shrinkage of at least 45% and no detectable crystallinity as measured by X-ray diffraction.

* * * * *